US006185960B1

(12) United States Patent
Voit

(10) Patent No.: US 6,185,960 B1
(45) Date of Patent: Feb. 13, 2001

(54) PROCESS AND DEVICE FOR THE PRODUCTION OF A PRESSURIZED GASEOUS PRODUCT BY LOW-TEMPERATURE SEPARATION OF AIR

(75) Inventor: Jürgen Voit, Schondorf S.A. (DE)

(73) Assignee: Linde Aktiengesellschaft, Wiesbaden (DE)

( * ) Notice: Under 35 U.S.C. 154(b), the term of this patent shall be extended for 0 days.

(21) Appl. No.: 09/288,226

(22) Filed: Apr. 8, 1999

(30) Foreign Application Priority Data

Apr. 8, 1998 (DE) ..... 198 15 885.8

(51) Int. Cl.[7] ..... F25J 1/00
(52) U.S. Cl. ..... 62/656; 62/646; 62/900
(58) Field of Search ..... 62/646, 656, 913, 62/900

(56) References Cited

U.S. PATENT DOCUMENTS

| | | | | |
|---|---|---|---|---|
| 5,084,081 | | 1/1992 | Rohde | 62/22 |
| 5,426,947 | * | 6/1995 | Grenier | 62/913 |
| 5,505,052 | * | 4/1996 | Ekins et al. | 62/913 |
| 5,666,825 | * | 9/1997 | Darredeau et al. | 62/656 |
| 5,678,425 | | 10/1997 | Agrawal et al. | 62/646 |

FOREIGN PATENT DOCUMENTS 0 044 679 1/1982 (EP) .
0 793 070 9/1997 (EP) .

* cited by examiner

*Primary Examiner*—Ronald Capossela
(74) *Attorney, Agent, or Firm*—Millen, White, Zelano & Branigan, P.C.

(57) ABSTRACT

In a process for the production of a pressurized gaseous product by low-temperature separation of air, which is at times done in a gas operation and at times in a combined operation, whereby in the gas operation and in the combined operation (a) purified charging air is cooled under pressure, partially liquefied, and subjected to rectification to produce gaseous and liquid fractions, (b) extremely cold liquid of at least one of the liquid fractions from the rectification is evaporated under elevated pressure by indirect heat exchange with feed air, heated, and obtained as a pressurized gaseous product, whereby in combined operation, (c) the cold that is required for this purpose is generated in an air-refrigeration cycle, by air being compressed in the refrigeration cycle and work expanded, in which case heat is removed from the air, and the actively depressurized air that is partially in countercurrent is heated again with the charging air that is to be cooled and then repressurized, (d) extremely cold liquid is produced and at least partially stored. During gas operation, the air throughput in the refrigeration cycle is reduced to zero, and extremely cold stored liquid is used to compensate for cold losses that are no longer covered by the refrigeration cycle. In the corresponding apparatus, during gas operation the compressor(s) for the supply of recycle air are switched off in a compressor station for recycle air and throttle air.

12 Claims, 4 Drawing Sheets

PROCESS AND DEVICE FOR THE PRODUCTION OF A PRESSURIZED GASEOUS PRODUCT BY LOW-TEMPERATURE SEPARATION OF AIR

FIELD OF THE INVENTION

The invention relates to a process for the production of a pressurized gaseous product by the low-temperature separation of air, which is at times carried out in a gas operation and at times in a combined operation, whereby in the gas operation and the combined operation

- purified feed air is cooled under a pressure, partially liquefied, and subjected to rectification so as to obtain gaseous and liquid fractions,
- extremely cold liquid from at least one of the liquid fractions from the rectification is evaporated under elevated pressure by indirect heat exchange with feed air, heated, and obtained as a pressurized gaseous product, whereby in combined operation

- the cold that is required for this purpose is generated in an air-refrigeration cycle, by air being pressurized in the refrigeration cycle and work expanded, whereby heat is removed from the air, and the work expanded air is partially reheated countercurrently to the feed air that is to be cooled, and the resultant reheated air is then repressurized,
- extremely cold liquid is produced and at least partially stored.

In addition, the invention relates to apparatus for conducting the process with

- a main compressor for feed air, whereby the exhaust pressure of the main air compressor also provides a working pressure for a subsequent purification unit,
- a pure-air line from the purification unit to a compressor station for the air in the refrigeration cycle and for the air supply for rectification,
- and a pressure-side conduit from the compressor station, which, on the one hand, empties into a line of the refrigeration cycle having at least one expansion turbine and, on the other hand, into a branch for throttle air to the columns.

BACKGROUND OF THE INVENTION

A process for the production of pressurized gaseous oxygen (DGOX) and small amounts of liquid oxygen (LOX) is known from publication EP 0 044 679 A1: Cold for air separation and the production of liquid product is furnished by an air refrigeration cycle. Said cycle is provided with two compressor stages in series: for compression of an air stream in the first stage to an intermediate pressure allowing work expansion of a partial stream of this air down to a lower pressure and a second compressor stage to compress the other partial stream of air to an even higher pressure allowing for throttle depressurization to the same low pressure. After the partial flows are combined and a liquid phase that is formed is branched off, the gas phase is recycled for compression, and the liquid phase is fed to the rectification after being divided into two throttled streams. In such a process, the refrigeration cycle cannot be turned off, and a returning of the refrigeration output results in energy-wasteful operation.

SUMMARY OF THE INVENTION

Objects of the invention include a process and a device of the above-mentioned type with energy-favorable production of the pressurized gaseous product and the liquid product, respectively, in variable amounts and with high availability of the production of the pressurized product.

Upon further study of the specification and appended claims, other objects and advantages will become apparent.

A characteristic feature of the process according to the invention is that during gas operation, the air throughput in the refrigeration cycle is reduced to zero and extremely cold stored liquid is used to compensate for cold losses that can no longer be covered by the refrigeration cycle. This makes it possible to produce pressurized gaseous product even in the case of a full liquid product tank by, for example, stored liquid product being fed to a heat exchanger countercurrently to the air that is used, whereby this air is cooled, partially liquefied, and fed to rectification, or the stored liquid is fed directly to rectification.

Extremely cold liquid of at least one liquid fraction from the rectification, for example, liquid nitrogen (LIN), liquid oxygen (LOX), or liquid air can be temporarily stored in a tank to compensate for cold losses in gas operation, whereby working tanks and/or product tanks are used as tanks for storing these fractions. In most cases, the use of product tanks is the most advantageous solution, while liquid air likely requires a working tank since liquid air in most cases plays no role as a product.

By "extremely cold liquid", is preferably meant a liquid having a temperature at least as low as about the temperature of liquid oxygen at the prevailing pressure under which it is stored; for example, liquid oxygen at atmospheric pressure without subcooling has a temperature of about −183° C., and at higher pressures commensurately higher.

When at least two tanks are used, at times alternate storage can be performed, whereby, on the one hand, in the event of increased high-pressure oxygen (DGOX) demand, in addition to the LOX from the rectification, temporarily stored LOX is removed from one tank, compressed, evaporated countercurrently and heated, and then released as a DGOX product, and in this case, cold is recovered countercurrently and used for production and intermediate storage of LIN product, whereby, on the other hand, in the event of low DGOX demand, correspondingly little LOX is released from the rectifying system as DGOX and instead more LOX is intermediately stored. The advantage lies in the fact that at times more DGOX is supplied than would be possible according to the design of the air separation by virtue of the fact that stored LOX is removed, and the cold content of the LOX corresponding to LIN are stored.

For rectification, a two-column process can be used, whereby cooling of the top of the pressurized column is done with an intermediate liquid from the low-pressure column, and heating of the bottom of the low-pressure column is ensured by indirect heat exchange with air. The two-column process is known from DE 196 09 490 A1 and is especially suitable if only a low oxygen purity is necessary.

Alternatively, a three-column process can also be used as a rectifying system, whereby a double column with a high-pressure part and a low-pressure part and an additional column under intermediate pressure are used. The three-column process is known from DE 195 37 913 A1. Even in the case of oxygen purities of >99.5 mol %, energy savings are possible with this process.

When pressurized gaseous product is recovered by evaporating and heating pressurized liquid, also called inner compression, countercurrently with hot air, air in the upper pressure level of the compression in the refrigeration cycle can be used or the air can be further compressed starting from this pressure level.

Work expansion can be carried out in at least one expansion turbine, whereby the power at the shaft of such a turbine is used in driving either a flow-generating generator or a booster, whereby the booster is used, for example, to further compress the air in the refrigeration cycle. In both cases, the energy of the expansion turbine is used advantageously.

A characteristic feature of the apparatus according to the invention is that the compressor station is designed with at least two compressors that are arranged in parallel and that are designed such that in gas operation, only one of the compressors is in operation, whereby this compressor outputs throttle air, and the refrigeration cycle is not exposed to air, while in operation with the production of pressurized product and liquid product, at least two compressors that are arranged in parallel arc in operation, and in addition to yielding throttle air, the refrigeration cycle is also exposed to air. Such a compressor station has several advantages. For gas operation, a compressor is operated at its energy-favorable working point; in the case of additional production of liquid product, multiple compressors, for example two, are operated near their optimal working point. In addition, multiple compressors simultaneously ensure machine redundancy, which correspondingly increases supply security in gas operation. Another advantage of the invention lies in the fact that, with a compressor that is operated as a rotary compressor, an energy-favorable liquid product can also be produced and this liquid operation is made possible by machine redundancy also with high supply security.

The expansion turbine in the refrigeration cycle can be designed as a turbine/generator unit. The energy that is produced in the expansion turbine is stored in the local power network.

The expansion turbine in the refrigeration cycle can be designed as a turbine/booster unit, whereby the booster is connected in the line of the refrigeration cycle as a secondary compressor of air from the compressor station. The energy that is produced in the expansion turbine is used to drive this booster, for example, via a common shaft with a booster.

A secondary compressor for air from the compressor station can be arranged in the line for the throttle air.

The process and the device according to the invention find advantageous use in an air separation unit for supplying a steel mill with nitrogen and oxygen.

Allowance can be made for the steel mill's variable demand for pressurized gaseous product in an energy-favorable way with high supply security. The invention as well as additional configurations of the invention are explained in more detail below based on the embodiments that are depicted in the drawings.

DETAILED DESCRIPTION OF THE DRAWINGS

FIG. 1

Figure 1:
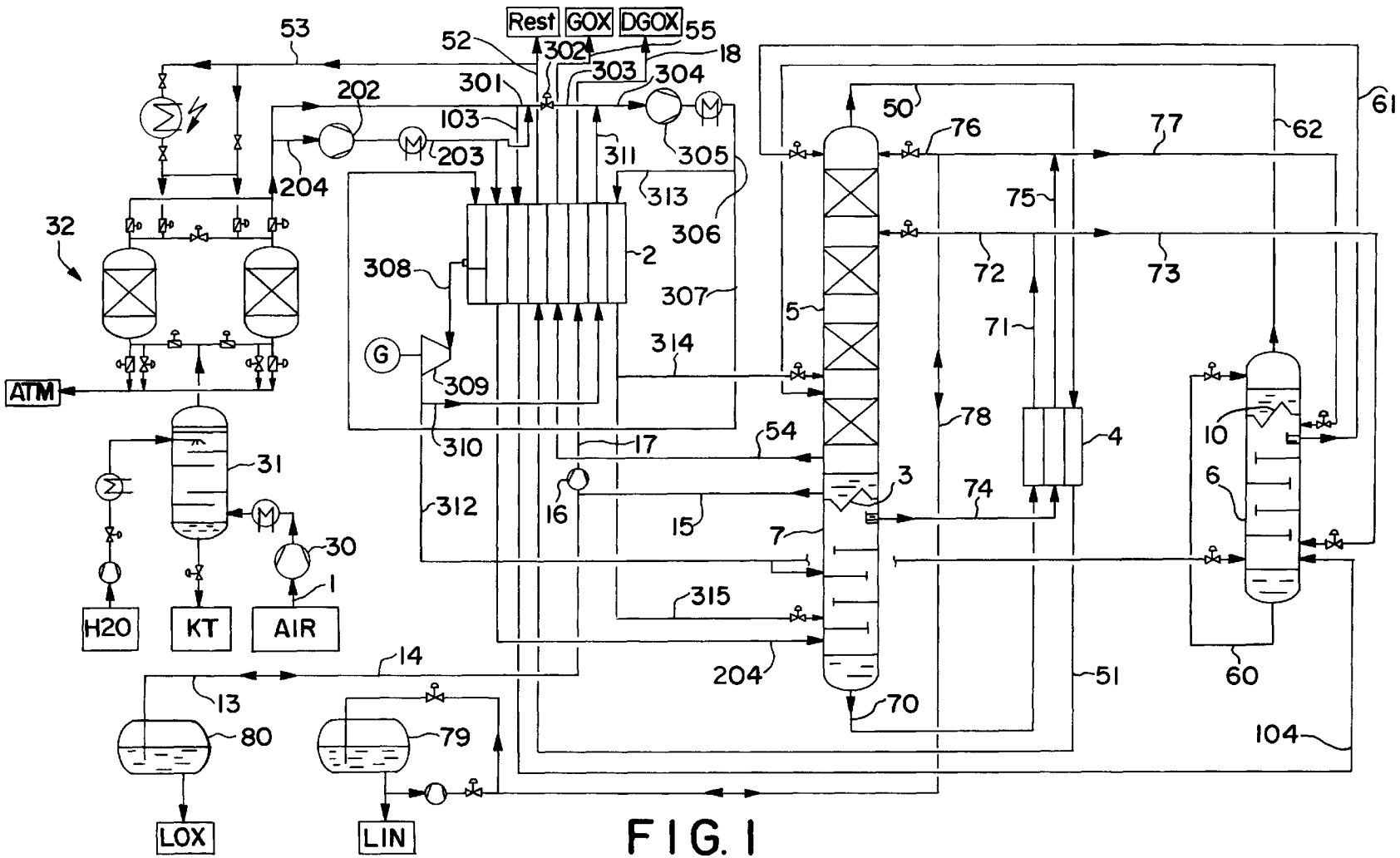
FIG. 1 shows an embodiment of the invention with three-column rectification and a turbine/generator unit.
Figure 2:
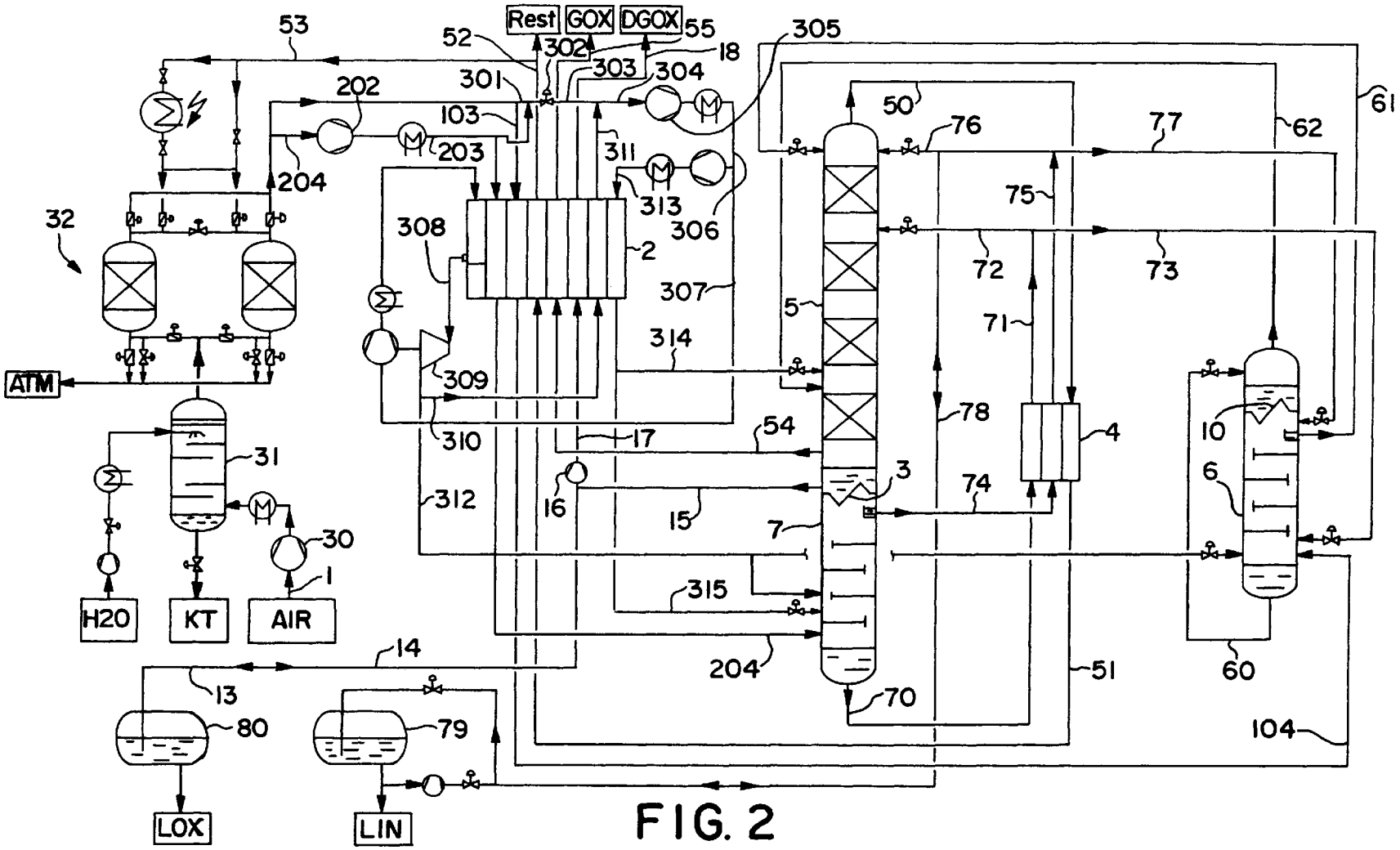
FIG. 2 shows a design with three-column rectification, a turbine/booster unit, and further throttle air compression.

In FIG. 1, air that is to be separated is suctioned off at 1 and compressed in an air compressor 30 to a starting pressure, basically intermediate-pressure column pressure (plus line losses) and pre-cooled in a cooling device 31 in direct contact with water, and water and carbon dioxide in particular are removed in a purification device (molecular sieve unit) 32.

The purified air is divided into three partial flows, of which the first is fed to a intermediate-pressure column 6 without further pressure-increasing measures via line 103, through a main heat exchange 2 and via line 104. Intermediate-pressure column 6 is operated—depending on the respective product specification and the pressure losses—under a pressure of 2 to 4 bar, preferably about 2.5 to 3.5 bar.

The second partial flow of purified air is compressed in a secondary compressor 202 to basically pressurized column pressure (plus line losses), cooled to dew-point temperature in a main heat exchanger 2 in indirect heat exchange with cold process streams, and introduced into the bottom of a pressurized column 7 (see positions 201, 202, 203, 2, 204 and 7). Pressurized column 7 is operated at an operating pressure of 5 to 10 bar, preferably 5.5 to 6.5 bar, and it is thermally coupled with a low-pressure column 5 via a main condenser 3. The latter operates at a pressure of 1.1 to 2.0 bar, preferably 1.3 to 1.7 bar. Secondary air compressor 202 can be driven by the same motor shaft as air compressor 30.

The third partial flow is fed via a line 301 to a compressor station 305 for turbine air (306, 307, 308) into a turbine 309 and/or for rectification air (313, 314, 315), whereby suction pressure 303 can be reduced by means of a throttle device 302, especially in the case of underload operation.

The air of the third partial flow is compressed in compressor station 305 from approximately intermediate-pressure column pressure to a pressure that corresponds to an air condensation temperature, which is at least approximately equal to the evaporation temperature of liquid high-pressure oxygen 17. Alternatively, the third partial flow of the purified air can also be branched off on the pressure side of secondary air compressor 202 if at the same time air (312) is fed from expansion turbine 309 to pressurized column 7. The suction pressure of compressor station 305 then corresponds to the pressurized column pressure.

A first portion 307 of highly compressed air 306 is fed to expansion turbine 309 at a temperature 308 that lies between the temperatures at the warm and cold ends of main heat exchanger 2 and is actively depressurized there to approximately intermediate-pressure column pressure. In this embodiment, the turbine output is transferred by a brake generator to the plant network. Part of the expanded turbine outlet flow is fed by main heat exchanger 2 via lines 310, 311, and 304 to the suction side of compressor station 305, and part is stored via line 312 in the bottom of intermediate-pressure column 6.

Against evaporating high-pressure oxygen 17, a second portion 313 of highly compressed air 306 is liquefied at least partially, preferably completely or almost completely, and expanded in one part 314 above the bottom into low-pressure column 5 and in another part 315 into the bottom of pressurized column 7.

Bottom liquid 70 and scrubbing nitrogen 74 from the top of pressurized column 7 are subcooled in an subcooling counterflow device 4 against a residual-gas flow 50 of low-pressure column 5 and in each case expanded into low-pressure column 5 and/or into the intermediate-pressure column (lines 71, 72, 73, 75, 76, and 77). Bottom liquid 60 and scrubbing nitrogen 61 from the intermediate-pressure column are also subcooled in subcooling countercurrent device 4 against residual-gas flow 50 (not shown in FIG. 1), or bottom liquid 60 is released directly into top condenser 10 of the intermediate-pressure column, and scrubbing nitrogen 61 is released onto the top of low-pressure column 5. A residual-gas flow 51 and products from the rectification section, in the example GOX and DGOX, are heated in main heat exchanger 2 to approximately ambient temperature (lines 51, 52, 54, 55, 17, and 18). Residual-gas flow 52 can be used completely or partially as flow 53 to regenerate molecular sieve station 32.

Liquid oxygen 15 is removed from the bottom of the low-pressure column, compressed to the required dispensing pressure depending on the product specification by means of an oxygen pump 16, or is completely or partially filled into an alternating storage tank 80. Liquid nitrogen 78 is removed from the top of low-pressure column 5 or branched from one of scrubbing nitrogen lines 75 or 61 and also internally compressed (not shown in FIG. 1) or stored in an alternate storage tank 79.

To increase the flexibility of the method of operation and the availability of the pressurized products, in the example of the DGOX, compressor station 305 consists of at least two compressors that are connected in parallel. This makes it possible to operate the alternate storage unit as a pure gas apparatus as well, to produce additionally the internally compressed high-pressure oxygen (DGOX), i.e., without liquid production. In the case of two compressors, one of the two compressors of compressor station 305 is taken out of service, and the second compressor takes over the task of evaporating internally compressed high-pressure oxygen 17. Compressor station 305 according to the invention thus consists of two compressors, each with different functions, of which one is used to generate cold for liquid production and the other is used to evaporate the internally compressed high-pressure oxygen.

In the example of an overproduction of DGOX that is limited in time, alternate storage tanks 79 and 80 are used to remove LOX and LIN as commercial products, as emergency storage tanks, as alternate storage for the LOX and LIN cold contents, and as a cold supply when the refrigeration cycle is shut down.

The compressor station that is indicated in FIG. 1 can contain single-stage or multi-stage machines with intermediate and/or subsequent cooling.

FIG. 2

Unlike in the embodiment of FIG. 1, in this embodiment the activity of expansion turbine 309 is transferred to a booster. In addition, throttle air flow 313 is compressed before it is cooled in main heat exchanger 2 and before subsequent Joule-Klevin expansion in double column 5, 7 to a pressure that is at least as high as the final pressure of compressor station 305 of the embodiment in FIG. 1.

FIG. 3

Figure 3:
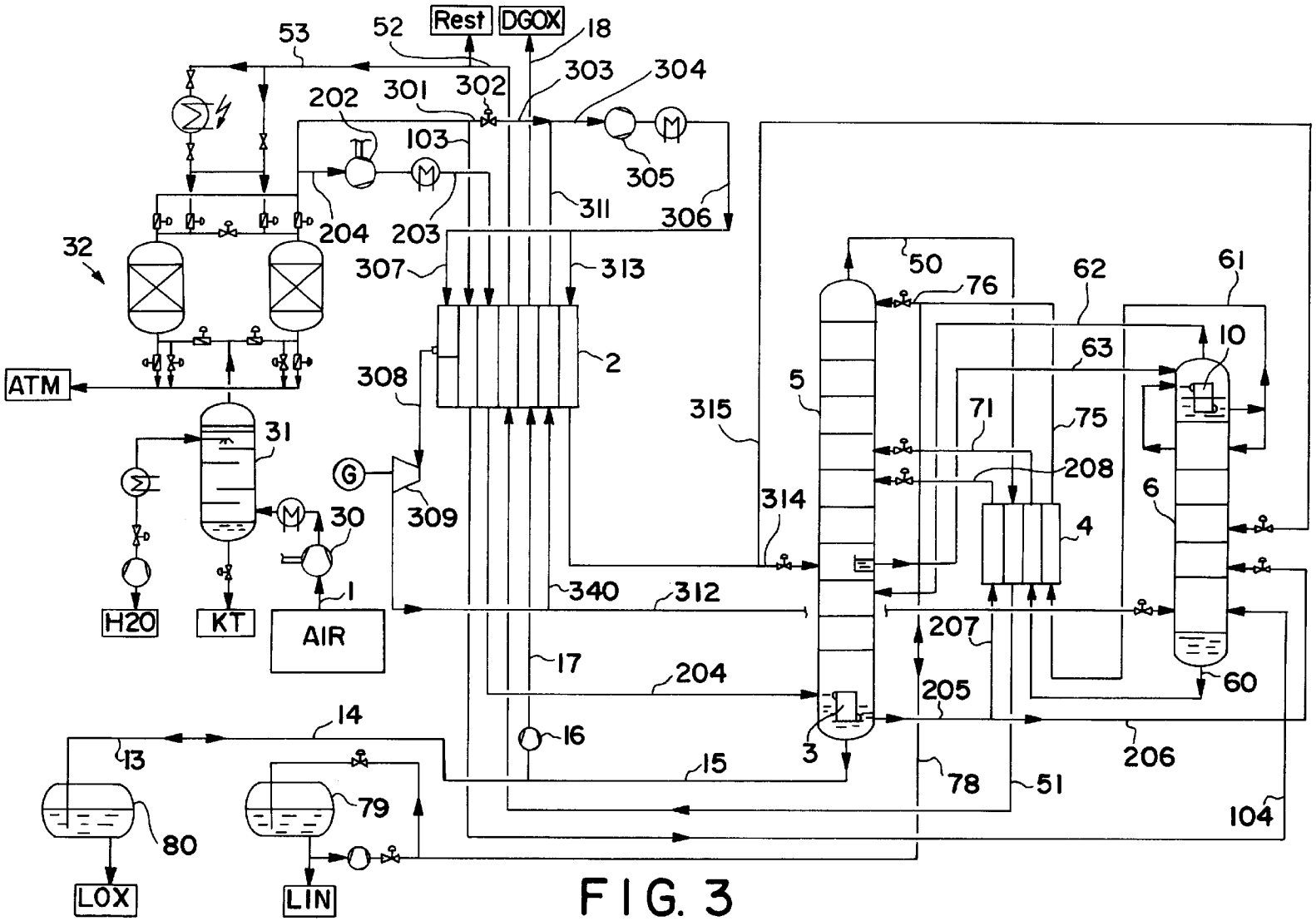
FIG. 3 shows an embodiment of the invention with two-column rectification and a turbine/generator unit.

In FIG. 3, air that is to be separated is suctioned off at 1 and compressed in an air compressor 30 to a starting pressure that is basically the intermediate-pressure column pressure (plus line losses) and is precooled in a cooling device 31 in direct contact with water, and water and carbon dioxide in particular are removed in a purification device (molecular sieve unit) 32.

The purified air is divided into three partial flows, of which the first can easily, without pressure-increasing measures, be introduced into a intermediate-pressure column 6 via line 103, via main heat exchanger 2, and via line 104. Intermediate-pressure column 6 is—depending on the respective product specification and the pressure losses—operated under a pressure of 2 to 4 bar, preferably about 2.5 to 3.5 bar.

The second partial flow of purified air is compressed in a secondary compressor 202 to a pressure that corresponds to an air-condensation temperature, which is at least approximately equal to the evaporation temperature of a liquid low-pressure oxygen 15, cooled in main heat exchanger 2 in indirect heat exchange with cold process streams, and introduced into a bottom condenser 3 of low-pressure column 5 (see positions 210, 202, 203, 2, 204 and 3).

The latter operates at a pressure of 1.1 to 2.0 bar, preferably 1.3 to 1.7 bar. Secondary air compressor 202 can be driven by the same motor shaft as air compressor 30.

In the case of high oxygen purities (greater than 99.5%), the two-column apparatus that is shown in the boundary case turns into the normal double-column apparatus (see, e.g., Patent DE 195 26 785 C1). The second partial flow then moves toward zero, and the low-pressure column taps of flows 62 and 63 move in the direction of the bottom of low-pressure column 5, so that top condenser 10 becomes the main condenser of the double column and the pressure of the intermediate-pressure column increases corresponding to thermal coupling.

The third partial flow is fed via a line 301 of a compressor station 305 for turbine air (306, 307, 308) to a turbine 309 and/or for rectification air (313, 314, 315), whereby its suction pressure 303 can be reduced by means of a throttle device 302, especially in the case of underload operation. In compressor station 305 the air of the third partial flow is compressed from approximately intermediate-pressure column pressure to a pressure that corresponds to an air-condensation temperature that is at least approximately equal to the evaporation temperature of liquid high-pressure oxygen 17.

A first partial flow 307 of highly compressed air 306 is fed to expansion turbine 309 via line 308 at a temperature that lies between the temperatures at the warm and cold ends of main heat exchanger 2 and is actively depressurized there to approximately intermediate-pressure column pressure. In this embodiment, the turbine output is transferred to the plant network by a brake generator. Part of the expanded turbine outlet flow is recycled by main heat exchanger 2 via lines 310, 311, and 304 to the suction side of compressor station 305, and part of said outlet flow is fed via line 312 into the bottom of intermediate-pressure column 6.

A second partial flow 313 of highly compressed air 306 is liquefied at least partially, preferably completely or almost completely against evaporating high-pressure oxygen 17 and is expanded in one part 314 above the bottom into low-pressure column 5 and in another part 315 into the bottom of intermediate-pressure column 6.

Bottom liquid 60 and scrubbing nitrogen 61 from top condenser 10 of intermediate-pressure column 6 are subcooled in an subcooling countercurrent device 4 against a residual-gas flow 50 of low-pressure column 5 and in each case are expanded into said low-pressure column (lines 71, 75, and 76). A residual-gas flow 51 and products from the rectification section, in the example DGOX, are heated in main heat exchanger 2 to approximately ambient temperature (lines 51, 52, 17, and 18). Residual-gas flow 52 can be used completely or partially for regeneration 53 of molecular sieve station 32.

Liquid oxygen 15 is removed from the bottom of the low-pressure column, compressed to the required dispensing pressure depending on product specification by means of an oxygen pump 16, or filled completely or partially into an alternate storage tank 80. Liquid nitrogen 78 is removed from the top of low-pressure column 5 or branched off from scrubbed nitrogen line 61 and also internally compressed (not shown in FIG. 1) or fed into alternate storage tank 79.

To increase the flexibility of the method of operation and the availability of the pressurized products, in the example of DGOX, compressor station 305 consists of at least two compressors that are connected in parallel. This makes it possible to operate the alternate storage unit as a pure gas apparatus as well, i.e., without liquid production, and additionally to produce internally compressed high-pressure oxygen (DGOX). In the case of two compressors, one of the two compressors of compressor station 305 is taken out of service, and the second compressor takes over the task of evaporating internally compressed high-pressure oxygen 17. Compressor station 305 according to the invention thus consists of two compressors with different functions in each case, whereby one compressor is used to produce cold for liquid production and the other is used to evaporate the internally compressed high-pressure oxygen.

In the example of an overproduction of DGOX that is limited in time, alternate storage tanks 79 and 80 are used to remove LOX and LIN as commercial products, as emergency storage tanks, as alternate storage for the LOX and LIN cold contents, and as a cold supply when the refrigeration cycle is shut down.

The compressor station that is indicated in FIG. 3 can contain single-stage or multi-stage machines with intermediate and/or subsequent cooling.

FIG. 4

Unlike in embodiment 3, in this embodiment the output of expansion turbine 309 is transferred to a booster. In addition, before throttle air flow 313 is cooled in main heat exchanger 2 and before subsequent Joule-Klevin expansion of it into columns 5 and 6, said air is compressed to a pressure that is at least as high as the final pressure of compressor station 305 of the embodiment in FIG. 3.

EXAMPLE

Figure 4:
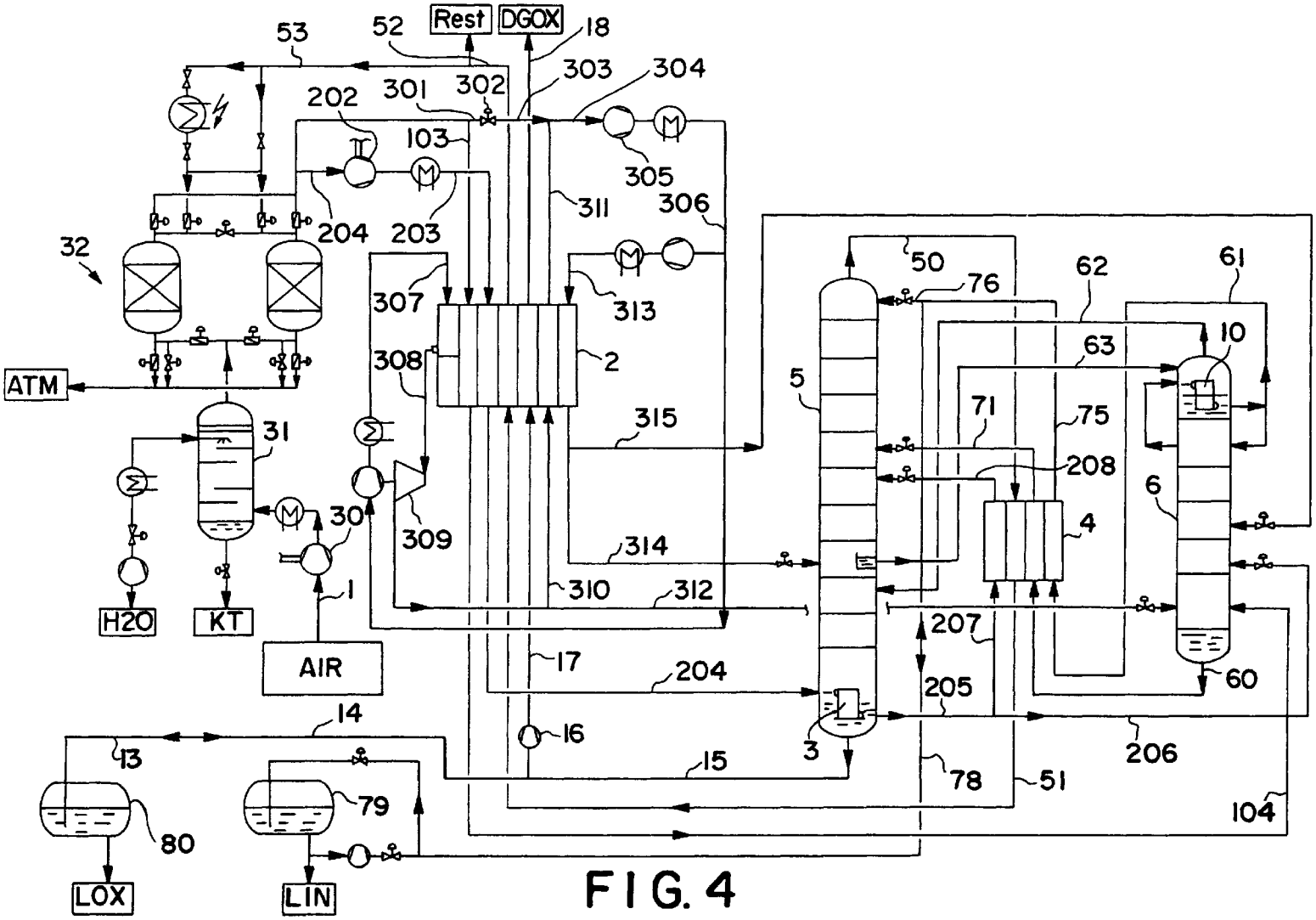
FIG. 4 shows a design with two-column rectification, a turbine/booster unit, and further throttle air compression.

To supply a steel mill, widely varying amounts of DGOX and pressurized nitrogen (DRGAN) are required. To supply the gas market, liquid products LOX, LIN, and liquid argon (LAR) are additionally to be produced to increase the efficiency of the production unit. The investment decision is made in favor of a unit with a turbine/booster unit and double-column rectification since no energy needs to be fed into the local electric network and since high oxygen purity is required. Until the argon recovery, not shown, is carried out, this corresponds to a unit as shown in FIG. 4. For four main types of operation A1, A2, A3, and A4 of the unit, the table shows the product flows, the alternate storage flows, and for the (cycle and the throttle air) compressor station, the table shows the number of operating compressors, air flows, and the energy demand of the unit. All gas and liquid flows are indicated in $m^3/h$, whereby in each case $m^3/h$ in the normal state at 1 atm and 273 K are meant. Operating cases A1, A2, and A3 are distinguished in that two compressors of the compressor station are in operation and supply a turbine flow and a throttle flow.

In operating case A1, 10,000 $m^3/h$ of DGOX is produced in addition to the liquid production. To supply the steel mill with 13,000 $m^3/h$ of DGOX as in operating case A2, 3000 $m^3/h$ is additionally removed from a LOX tank in liquid form as LOX, and it is released internally compressed as DGOX. The cold content of the LOX is used and is sufficient to fill the LIN tank with 2,800 $m^3/h$. In operating case A3, only 7,000 $m^3/h$ of DGOX is released to the steel mill. The LOX tank that is emptied in operational case A2 is filled again with 3000 $m^3/h$ of LOX. The cold that is required for this purpose is fed with LIN from the LIN tank that is filled based on operating case A2.

In operating case A4, only one compressor is in operation in the compressor station. It supplies the throttle flow; liquid is not produced. Only for the maximum required amount of DGOX of 13,000 $m^3/h$ in the steel mill is the cold output that is required for this purpose to be an order of magnitude smaller than in operating cases A1, A2, and A3; the equivalent required turbine flow needs to be only 4000 $m^3/h$. The refrigeration cycle of the unit is therefore advantageously covered by liquid from the tanks, and the turbine flow is switched off. Other operating cases are conceivable. The above—mentioned operating cases are distinguished especially in that all operational requirements are met advantageously with energy since the machines are operated at their design point at about 100% output. The flow consumption of the device is almost constant most of the time. Therefore, the electric utility companies can provide power at lower cost.

TABLE

| Operating Case | | A1 | A2 | A3 | A4 |
|---|---|---|---|---|---|
| Intake air | $m^3h$ | 65.000 | 65.000 | 65.000 | 65.000 |
| Products | | | | | |
| DGOX | $m^3h$ | 10.000 | 13.000 | 7.000 | 13.000 |
| LOX | $m^3h$ | 3.000 | 3.000 | 3.000 | — |
| LIN | $m^3h$ | 4.000 | 3.000 | 4.300 | — |
| DRGAN | $m^3h$ | 2.000 | 2.000 | 2.000 | 2.000 |
| LAR | $m^3h$ | 430 | 430 | 430 | 430 |
| Alternate storage currents | | | | | |
| LOX to the tank | $m^3h$ | — | — | 3.000 | — |
| LIN to the tank | $m^3h$ | — | 2.800 | — | — |
| LOX from the tank | $m^3h$ | — | 3.000 | — | — |
| LIN from the tank | $m^3h$ | — | — | 2.800 | — |
| Compressor station | | | | | |
| Number of compressors operated | $m^3h$ | 2 | 2 | 2 | 1 |
| Turbine current | $m^3h$ | 51.000 | 43.500 | 57.000 | 4.000 |
| Throttle current | $m^3h$ | 21.000 | 23.000 | 17.000 | 23.000 |
| Current consumption | kW | 11.000 | 11.000 | 11.000 | 7.700 |

The preceding examples can be repeated with similar success by substituting the generically of specifically described reactants and/or operating conditions of this invention for those used in the preceding examples. Also, preceding specific embodiments are to be construed as merely illustrative, and not limitative of the remainder of the disclosure in any way whatsoever.

The entire disclosure of all applications, patents and publications, cited above and below, and of corresponding German application 19815885.8, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A continuous process for the production of pressurized gaseous product by low-temperature separation of air, comprising conducting the process alternately in a gas operation mode and in a combined operation mode, dependent on the demand for particular fluids, said process comprising during both modes of gas operation and combined operation conducting the following common steps:

cooling purified feed air under a pressure, partially liquefying the resultant cooled feed air and subjecting the resulting cool feed air to rectification so as to obtain gaseous and liquid fractions, evaporating extremely cold liquid from at least one of the liquid fractions from the rectification under elevated pressure by indirect heat exchange with feed air, heating the evaporated fraction and recovering the heated and evaporated fraction as a pressurized gaseous product, and for the mode of combined operation, conducting the follow steps:

generating cold for cooling the feed in an air-refrigeration cycle, comprising pressurizing and work expanding air so as to remove heat from the air, reheating the work expanded air partially countercurrently to the feed air to be cooled, then repressurizing resultant reheated air and re-work expanding said reheated air, thereby forming a recirculating refrigeration cycle, and, withdrawing extremely cold liquid during said rectification and at least partially storine said extremely cold liquid, and for the mode of gas operation, reducing the air in said air-refrigeration cycle to zero, and utilizing the extremely cold stored liquid as a coolant to compensate for cold losses previously covered in the mode of combined operation by the recirculating air-refrigeration cycle.

2. A process according to claim 1, wherein extremely cold liquid of at least one liquid fraction from the rectification, liquid nitrogen (LIN), liquid oxygen (LOX), or liquid air, is intermediately stored in a tank to compensate for cold losses in gas operation, whereby buffer containers and/or product tanks are used as tanks for storing these fractions.

3. A process according to claim 1, employing at least two tanks wherein, when there is increased demand for high-pressure oxygen (DGOX), in addition to the LOX from rectification, LOX that is temporarily stored is removed from the one tank, compressed, evaporated in countercurrent and heated, and then released as a DGOX product, and in this case, cold is recovered in countercurrent and is used for the production and intermediate storage of LIN product, and conversely, when there is low demand for DGOX, correspondingly little LOX is released from the rectifying system as DGOX and instead more LOX is intermediately stored.

4. A process according to claim 1, said rectification comprising a two-column process whereby top cooling of the pressurized column is provided for by an intermediate liquid from a low-pressure column and bottom heating of the low-pressure column is performed by indirect heat exchange with air.

5. Process according to claim 1, said rectification a three-column process whereby a double column with a high-pressure part and a low-pressure part and an additional column under intermediate pressure.

6. A process according to claim 1 said pressurized gaseous product being produced by evaporation and heating of liquid under pressure, in countercurrent with warm air, and wherein compressed air is diverted from the air-refrigeration cycle and is further compressed.

7. A process according to claim 1, comprising conducting said work expanding in at least one expansion turbine, having an output shaft driving a booster so as to further compress air in the refrigeration cycle.

8. In the operation of a steel mill, conducting the process according to claim 1 to supply said steel mill with nitrogen and oxygen.

9. A device for separating air into product streams, said device comprising:

a main compressor for charging air, purification means connected downstream of said main compressor for purifying resultant compressed air, recirculating refrigeration cycle means comprising a compressor station, rectification column means, a pure-air line from said purification means to said compressor station, and a pressure-side line from the compressor station connected to at least one expansion turbine in said refrigeration cycle means, said pressure-side line comprising a branch line comprising throttle means for throttling air, said branch being connected to said rectification column means, and said compressor station comprising at least two compressors arranged in parallel and means providing that in a gas operation, only one of the compressors is in operation, said compressor being not in communication with said refrigeration cycle, and being in communication with said rectification column means, and means for the production of pressurized gaseous product and liquid product, comprising the least two compressors are arranged in parallel being both in operation, one compressor producing throttle air for the rectification column and the other compressor being in communication with the refrigeration cycle means for supplying air.

10. A device according to claim 9, wherein the expansion turbine in the conduction line of the refrigeration cycle comprises a turbine/generator unit.

11. A device according to claim 9, wherein the expansion turbine in the conduction channel of the refrigeration cycle comprises a turbine/booster unit, said booster in the conduction line of the refrigeration cycle being connected as a secondary compressor of air from the compression station.

12. A device according to claim 11, wherein a secondary compressor for air from the compressor station is arranged in the conduction line for throttle air.

* * * * *